US008020244B2

(12) United States Patent
Mashiko

(10) Patent No.: US 8,020,244 B2
(45) Date of Patent: Sep. 20, 2011

(54) TOOTHBRUSH

(76) Inventor: Nobuhiro Mashiko, Ibaraki (JP)

( * ) Notice: Subject to any disclaimer, the term of this patent is extended or adjusted under 35 U.S.C. 154(b) by 849 days.

(21) Appl. No.: 11/999,633

(22) Filed: Dec. 7, 2007

(65) Prior Publication Data

US 2009/0000047 A1 Jan. 1, 2009

(30) Foreign Application Priority Data

Jun. 26, 2007 (JP) ..... 2007-167463

(51) Int. Cl.
*A46B 9/04* (2006.01)

(52) U.S. Cl. ..... 15/167.1; 15/176.1; 15/201; 15/202

(58) Field of Classification Search ..... 15/167.1, 15/176.1, 176.4, 176.5, 201, 202
See application file for complete search history.

(56) References Cited

U.S. PATENT DOCUMENTS

| | | | | |
|---|---|---|---|---|
| 2,197,551 | A * | 4/1940 | Jensen | 15/186 |
| 2,429,740 | A * | 10/1947 | Aufsesser | 15/167.1 |
| 2,706,825 | A * | 4/1955 | Blakeman | 15/176.4 |
| 4,115,894 | A * | 9/1978 | Peterson | 15/167.1 |
| 5,355,546 | A * | 10/1994 | Scheier et al. | 15/167.2 |
| 5,408,717 | A * | 4/1995 | Wenzer | 15/167.1 |
| 5,749,116 | A * | 5/1998 | Wieder et al. | 15/160 |
| 5,926,898 | A * | 7/1999 | Kramer | 15/167.1 |
| 2005/0188487 | A1 * | 9/2005 | Moskovich et al. | 15/167.1 |

FOREIGN PATENT DOCUMENTS

| | | | |
|---|---|---|---|
| JP | 1976-110761 | | 9/1976 |
| JP | 1985-147321 | | 1/1985 |
| JP | 1985-86343 | | 6/1985 |
| JP | 1987-24731 | | 2/1987 |
| JP | 11513924 | T | 11/1999 |
| JP | 2001-008735 | | 1/2001 |
| JP | 2001-190333 | | 7/2001 |
| JP | 2008-178655 | A | 8/2008 |
| JP | 2009-297522 | | 12/2009 |
| WO | 2006/012956 | * | 2/2006 |

* cited by examiner

*Primary Examiner* — Mark Spisich
(74) *Attorney, Agent, or Firm* — Birch, Stewart, Kolasch & Birch, LLP

(57) ABSTRACT

A toothbrush having a compact toothbrush head, which contributes to the economy, cost reduction, and saving of resources, includes a brush base which is provided with consumable brush bundles and which is attachable to and detachable from the toothbrush head. The brush base of the toothbrush is an elastic member in order to absorb excessive pressure added to the brush bundles and secure stable elasticity and a substantial elastic amount for those brush bundles in contact with recessed and projected portions of teeth or those brush bundles entered into space between teeth to enable user to gently clean the teeth and gum. Even when excessive pressure is added to brush bundles, the inventive toothbrush effectively functions for the teeth brushing process. A hole penetrates perpendicularly the toothbrush head, and a slit is formed therein. Further, the inner surface of the slit is formed with recesses and projections.

2 Claims, 10 Drawing Sheets

TOOTHBRUSH

CROSS REFERENCE TO RELATED APPLICATION

The entire disclosure of the Japanese Patent Application No. 2007-167463, filed on Jun. 26, 2007, including its specification, drawings, and summary, incorporated herein is shown in reference to its entirety.

BACKGROUND OF THE INVENTION

1. Field of the Invention

The present invention relates to a toothbrush, which is capable of absorbing excessive force added to a toothbrush and effectively cleaning recessed and projected portions of teeth as well as the space between them, and provided with an attachable and detachable brush base.

2. Background Art

There are various conventional arts related to a toothbrush including the one that controls the force added to a toothbrush, or the one that applies an elastic member to the brush fixing portion or to the brush base so as to effectively clean the recessed and projected portions of teeth, or the one that infuses vapor or liquid into a bag beneath the brush-fixing portion in place of an elastic member so as to control the force added to the toothbrush. For example, as described in Japanese Utility Model Laid-Open Publication Showa 51-110761 (1976), there is such a prior art that applies an elastic member to the brush base, or the one that buries brush bundles into an elastic member as described in Japanese Patent Laid-Open Publication 2001-190333, or the one that uses an elastic body filled with vapor or liquid as described in Japanese Patent Laid-Open Publication 2001-8735. Further, Japanese Patent Laid-Open Publication Heisei-06-304022 (1996) describes a toothbrush, which is provided with an attachable and detachable brush base fitted with brush bundles so as to help promoting economy and saving resources. Reference patent documents:

With reference to any conventional toothbrush, in order to absorb the force added to the toothbrush so that an average force of the brush bundles can be applied to recessed and projected teeth, there are various toothbrushes including the one that buries brush bundles into an elastic member, or the one that aims at absorbing the force added to brush bundles by securing an elastic member beneath the brushes. However, unless the elasticity varies, none of these conventional toothbrushes can achieve the aimed utility. Hence, in order to secure a correct amount of the recesses and projections of teeth via an elastic member, it was quite essential that the thickness of an elastic member or body be increased. Further, in order to achieve the intended object by elongating the elastic member, it was required to use a soft elastic member so as to secure a proper elongation amount. As a result, elasticity lost own effect by a maximum extent when no pressure was added to the brush-fixing portion to cause brush bundles to topple themselves by a maximum degree. Conversely, when aiming at securing a greater amount of elasticity, it in turn requires much time to restore the proper state of brush bundles after being subject to an elastic action. Further, when any of the brush bundles enters into the space between teeth or when finely performing a brushing process, proper function of the toothbrush can hardly be exerted. In the case of such a toothbrush fitted with an elastic member at an upper portion of the stem of the toothbrush head component, structurally, it is rather difficult to contract the corresponding toothbrush head component, and thus, it is inappropriate for a user to effectively apply a thin head component to the brushing. With reference to such a toothbrush capable of attaching and detaching a brush base fitted with brush bundles, it is considered that the stem thereof is durable for a period longer than that of the conventional toothbrushes. It is an object of the above toothbrush capable of attaching and detaching the brush base fitted with brush bundles so as to solely replace consumable brush bundles fixed to the brush base without wasting material resources so as to help saving these resources via economy and cost reduction to be advantageous on the part of consumers as well as toothbrush manufacturers.

Japanese Utility Model Laid-Open Publication Showa 51-110761 (1976), refers to a toothbrush, which is provided with brush bundles inside and above an elastic member secured onto a stem of a toothbrush head component. In order to achieve the intended object and secure a proper amount of elasticity, the toothbrush uses a soft and relatively thick elastic member. As a result, when pressure was added to the brush bundles, the elasticity at the brush-fixing portion became the least, thereby causing the brush bundles to topple themselves by a substantial extent, thus indicating that this toothbrush was not suitable for performing a brushing process when insubstantial pressure was added to teeth. For example, since no pressure is added to brush bundles that are caught between teeth, due to substantial toppling effect generated at the brush-fixing portions, in particular, when finely performing a brushing process, actual brushing effect is practically lost. It is said that a substantial amount of pressure should be added to teeth, in principle, approximately 200 grams of pressure should be added thereto as an appropriate amount. When no pressure is added to teeth, teeth cleaning effect is hardly achievable. It was clarified via an observation on the behavior of the elasticity that the most remarkable toppling effect was generated at the brush-fixing portion before the elasticity became variable. Hence, it was identified that, relatively to the contraction of the elasticity, elastic property of the elastic member was strengthened to cause the elastic member to be contracted. Conversely, the softer the elastic member, the more the pressure added to the brush bundles can be absorbed. Nevertheless, it in turn requires much time to restore the initial state of the brush bundles that incurred elastic deformation, thereby disabling the toothbrush to quickly and effectively deal with variations caused by the recesses and projections of teeth during a brushing process.

Japanese Patent Laid-Open Publication 2001-190333 refers to a toothbrush that has an elastic member at the brush-bundle fixing portions, where the elastic member inclusive of the elongated configuration is designed to incline itself so as to enable the brush bundles to effectively contact the recessed and projected portions of teeth. Nevertheless, in order to finely perform a brushing process, since the brush bundles are obliquely configured, pressure added to teeth is externally rejected from those brush bundles caught in the space between teeth or in the recessed portions thereof, and thus, the toothbrush cited in Japanese Patent Laid-Open Publication 2001-190333 is inappropriate for practical use. Like the case cited in Japanese Utility Model Laid-Open Publication Showa 51-110761 (1976), the elastic member becomes the softest while the elastic member remains free from the elastic deformation. In other words, the higher the amount of the elastic deformation, the higher the hardness of the elastic member. In order to enable the brush bundles to effectively contact the recessed and projected teeth with an average pressure, unless such a soft elastic member having ductile property or shrinkable property is used, the aimed object can hardly be achieved. Further, in this case, it takes much time for restoring the initial state of the brush bundles by a period longer than the case of using a hard elastic member, and so, the prior toothbrush cited in the above patent document 2 is inappropriate for practical use.

Japanese Patent Laid-Open Publication 2001-8735 refers to such a toothbrush, which is capable of controlling pressure of an elastic member filled with vapor or liquid beneath the brush-fixing portions so that the aimed object can be achieved. However, the above toothbrush consists of a complex structure and can hardly secure stable elasticity. In the case in which the elastic member is filled with vapor for example, depending on the difference in the atmospheric pressure, actual locations, variation of atmospheric temperature, water temperature, or body temperature, or due to the rise of vapor pressure caused by repeated elastic deformations, actual vapor pressure inside the elastic member is variable while performing a brushing process, thereby causing the elasticity to be variable likewise. When vapor leaks out from the elastic member, the elastic member incurs deformation without being restored into the initial state, and yet, it incurs infiltration of water. Even when vapor remains without leakage, there may be such a case in which the elasticity could vary itself due to variation of temperature or atmospheric pressure, or else, water drops or dew may be generated. Occurrence of these phenomena leads users to feel concern about unhygienic outcome. Above all, intrinsic stable elasticity will be lost in the above cases. Even if it is possible to retain the variable vapor pressure to be constant, the above toothbrush involves much difficulty to deal with. Even in the case of such an elastic member filled with liquid, much time is required to cause the liquid to flow itself, and yet, it also takes much time to enable the elastic member to restore the initial state after incurring deformation. If the liquid leaks out from the elastic member, it prevents the elastic member from restoring the initial state. These phenomena are quite similar to those took place in the toothbrush cited in Japanese Utility Model Laid-Open Publication Showa 51-110761 (1976). The complex structure of the toothbrush cited in Japanese Patent Laid-Open Publication 2001-8735 involves the rise of production cost and potential leakage of liquid as a crucial issue against preservation of oral sanitation for consumers.

Japanese Patent Laid-Open Publication Heisei-06-304022 (1996) refers to such a toothbrush, which is capable of optionally attaching and detaching the brush base to and from the toothbrush head component. The brush base is replaceable. This toothbrush has the aimed object and practical effect similar to those of the replaceable brush base related to the present invention. Up to the present, in order to form the brush base, the above toothbrush has been using a hard synthetic resin consisting of a quality close to that of the material of the stem of the toothbrush head component. Hence, whenever repeating processes for attaching and detaching the brush base, due to the friction generated between the brush base and the head component, the brush base fixing portion of the stem of the head component is worn off. Further, if there were even the slightest space between the stem of the head component and the brush base fixing portion, it will cause mutual friction to occur during the teeth brushing process. This in turn causes the teeth brushing duration to be prolonged, and yet, expands the toppling extent before eventually causing the brush-base fixing portion of the stem of the head component to be worn off otherwise should securely be avoided. Due to these reasons, after using the above toothbrush for a long while, there is a potential fear of generating unpleasant feeling caused by unwanted oscillation generated by the toppling during a teeth brushing process or potential fear of causing the newly replaced brush base to be disengaged easily.

SUMMARY OF THE INVENTION

It is a primary object of the present invention to solve the above problems by providing a novel toothbrush, which is capable of absorbing excessive pressure added to brush bundles so as to effectively clean teeth with a stable pressure added to the brush bundles throughout the recessed and projected portions of teeth and the space between teeth. It is a further object of the present invention to provide a novel toothbrush, which is capable of causing a pressure added to teeth via brush bundles to be closer to an optimum pressure level independently of the environmental locations and further capable of securing stable elasticity and a greater amount thereof with a smallest possible toothbrush head component so that it can effectively function for brushing teeth. The present invention further aims at eliminating wasteful use of material resources, for example, by providing a replaceable brush base so as to compensate for the consumed parts only. In this case, it is intended to make use of the stem of the toothbrush for a long period of time as practiced for any conventional toothbrush, thereby aiming at contributing to economy, cost reduction, and saving material resources.

To realize the above objects, the present invention provides a novel brush base, which is semi-spherically configured with an elastic member having a hollow cavity with the bottom surface being open, thus forming a brush base configured with a semi-spherical elastic member combined with brush bundles, where the brush bundles are buried into the elastic member by way of aligning the tip portions of the brush bundles perpendicularly to the toothbrush head. Due to this unique arrangement, the elasticity behaves itself in the unique way totally different from that is performed in any of conventional toothbrushes. This arrangement enables the semi-spherical elastic member to quickly restore the initial state after causing recessed portion to be deformed. In consequence, air existing in the hollow the brush base goes out from the brush head and enters therein. In order that the resistance generated during the aerial emission and infiltration would not obstruct deformation and restoration of the shape of the above elastic member, a relatively large hole is formed perpendicularly through the toothbrush head. Not only for the aerial emission and infiltration, but the above hole also advantageously functions to promote washing effect on the back surface of the elastic member so that excessive deformation will not be generated even when the elastic member incurs remarkable deformation (refer to FIG. 10). Further, an annularly configured elastic member integrally molded with the brush base is formed, which is available for loading the attachable and detachable brush base into the toothbrush head. Further, a groove portion is formed inside the toothbrush head so as to store the annularly formed elastic member therein. The surface of the toothbrush head or the groove surface is provided with recesses and projections.

The present invention provides the following advantages.

The brush base is semi-spherically configured with an elastic member having a semi-spherical hollow cavity with the bottom surface being open in combination with brush bundles. This arrangement makes it possible to effectively clean the recessed and projected portions of teeth and the space between teeth and absorbs excessive pressure added to teeth and the gum so as to minimize potential injury. Further, since a number of brush bundles are secured to the semi-spherically configured elastic member, the resultant elastic member generates substantial elastic force greater than that can be generated by the one solely consisting of a semispherically configured elastic member. The above semispherical elastic member combined with the brush bundles is compatible with the brushing process added with pressure and motions generated in the overall directions.

The toothbrush head is provided with a substantially large hole perpendicularly through the stem thereof. Provision of this hole prevents the inventive brush base from excessively being deformed. Further, inclusive of a certain resistance via emission and infiltration of water and sputum out from and into the hollow cavity of the brush base, since there is no resistance in the aerial emission and infiltration, the brush base quickly restores the proper state after being deformed into the recessed configuration, thereby enabling the brush base to exert advantageous function while finely performing a brushing process against the recessed and projected portions of teeth.

Further, even when the brush base remains being deformed into the recessed aspect, independently of the magnitude of the pressure added to brush bundles, the elastic force of the elastic member at the brush-fixing portions remains sufficiently stable, and thus, this condition minimizes variable readiness for the brush bundles when brushing the recessed and projected portions of teeth or the space between teeth. Even when the elastic member remains being deformed, it is possible to clean teeth by applying pressure from the brush bundles, in which the applicable pressure remains stable in the condition very close to an optimum pressure level. In particular, the brushing using the inventive system is quite effective for cleaning the inmost teeth.

When an intense pressure has been applied to brush bundles, the recessed condition of the brush base is physically sensed by the user. This in turn generates an effect of notifying the user of the excessively added pressure. Even when the user performs a teeth brushing process in the condition in which the elastic member has incurred deformation to the tolerable limit by the pressure excessively applied to the brush bundles, it is still possible to retain the cleaning effect and the elastic effect to enable the brush bundles to enter into the space between teeth by effectively absorbing pressure, changing the brushing direction so that the brush bundles can envelop teeth, and also by way of increasing the density of the brush bundles. Further, it is also possible to minimize potential fear of excessively shaving teeth and potential injury of the gum as well.

Even when a third person performs teeth brushing for the sake of nursing care, it is possible for the inventive toothbrush to deter possible injury against teeth and the gum by enabling the nursing person to sense excessive force applied thereto. Further, the inventive toothbrush is also effectively usable for anyone having a physical defect in the hand for holding the stem or properly adjusting applicable pressure including aged people.

Since brush bundles are secured to the brush base composed of a semispherical elastic member such that the tip ends of brush bundles can be aligned perpendicularly to the toothbrush head 1*a*, it is possible to secure a wider superficial area than the method of securing the brush bundles to a plane brush base. This makes it possible to dispose a greater number of brush bundles on the brush base to increase the density of brush bundles. Further, this in turn facilitates deformation of the recessed portion of the elastic member as the brush base by effect of the increased density of brush bundles and the brush bundles themselves. Further, since the length of the brush unit is variable in the center and external portions, it is possible to provide softer brush bundles in the external portions easily coming into contact with the gum than those which are provided in the center portion thereof without necessarily changing the material and the thickness of the brush base. Accordingly, it is possible to provide a novel toothbrush ideally suited for protecting the gum.

Considering that a satisfactory effect can also be generated without combining different kinds of brush bundles, the inventive structure contributes to the reduction of production cost. Further, since the center portion of the elastic member as the brush base is more elastically deformable due to the recess thereof than in the external portion, and yet, since the pressure added perpendicularly to the center portion of the stem of the brush unit is also added perpendicularly to the surface of the brush base, the brush unit can easily secure the elastic effect, and thus, it is also allowable to provide short-length and rather hardly configured brush bundles.

When the toothbrush head is engaged with the brush base, and further, when the bend of the elastic member is restricted inside the through-holes provided for the toothbrush head, elasticity rises in the elastic member. Hence, it is possible to make the elastic member by applying rather soft elastic material. In this case, it is possible to retain the pressure constant until the recessing deformation begins after applying the pressure to the elastic member. This in turn enables the elasticity to easily be exerted via through-holes after completing deformation by applying rather weak elasticity present in the brush-bundle fixing portion.

Since it is possible to adjust the height, thickness, and the hardness of the elastic member and the hardness of brush bundles in various combination methods, the elasticity can be sorted into various kinds of grade. This makes it possible to choose proper elasticity depending on the actual condition of user's teeth and gum and the way of teeth-brushing.

When the toothbrush head is engaged with the brush base, since the elastic member fully covers the toothbrush head, even when the toothbrush head incurs crack, user may be rest assured of safety due to satisfactory washing effect to ensure sanitation.

When the brush base is arranged to be attachable to and detachable from the toothbrush head, the toothbrush head can be produced from at least one kind of material. Since this contributes to the reduction of production cost and dispenses with the wear due to friction, user is enabled to discard only the brush base attached with the worn brush bundles, thus contributing to the user's economy and also to the saving of resources. Further, since it is also possible to produce the toothbrush head discretely from the brush base at different locations, it also contributes to the cost saving on the part of producers.

The annular portion of the inventive brush base arranged to be attachable and detachable is composed of the elastic material, the elastic member can easily be mounted into and dismounted from a slit formed in toothbrush head. When being mounted therein, the elastic member is secured with intense adhesion. Further, since the surface of the annularly formed elastic member is also elastic, depending on the material of the stem of the toothbrush, available elastic member may be composed of fairly soft elastic material. Hence, unlike such a problem existing in any of conventional brush bases being attachable to and detachable from the toothbrush head, due to friction at the fixing contact portion generated while repeating the fixing and removing it or due to friction caused by the movement of the fixing contact portion that can possibly occur on the way of performing a teeth brushing routine, the inventive toothbrush is free from causing the brush-base fixing portion of the toothbrush head to be worn off. Hence, by replacing only the fixing portion of the consumable brush base of the toothbrush head, user will be able to use the toothbrush for a longer period of time than the life of any conventional product. Further, even when the annular elastic member is worn off, unwanted oscillation rarely occurs via saccadic motions. The worn-off elastic member is hardly removable from the toothbrush head.

Including the case of the brush base being attachable and detachable as embodied by the present invention, by generating recessed and projected portions on the surface or in the slit of the toothbrush head, the elastic member deforms itself according to the recesses and projections, thus minimizing torsion and slip of the annular elastic member and the brush base likely to be generated during a brushing routine. This in turn prevents the elasticity of the elastic member as the brush base from being varied and also suppresses the wear caused by friction. Further, due to the provision of the recessed and projected portions, the brush base can be prevented from easily being removed from the toothbrush head.

As described above, including the elasticity at the brush fixing portion, it is possible to secure an ideal elasticity close to an optimum pressure suitable for teeth brushing everywhere in any location and country irrespective of environment, thereby enabling to secure stable elasticity and a substantial amount thereof. This makes it possible to effectively clean recessed and projected local spots in teeth and space between teeth. By arranging the brush base attachable to and detachable from the toothbrush head and further by making it replaceable, it has successfully become practicable to produce a toothbrush having a compact toothbrush head suitably capable of treating teeth and gum, which facilitates economy and cost reduction for users and producers so as to contribute to the saving of resources as well.

DESCRIPTION OF THE PREFERRED EMBODIMENTS

Referring now to the accompanying drawings, a practical mode for realizing the toothbrush according to an embodiment of the present invention is described below.

Figure 1:
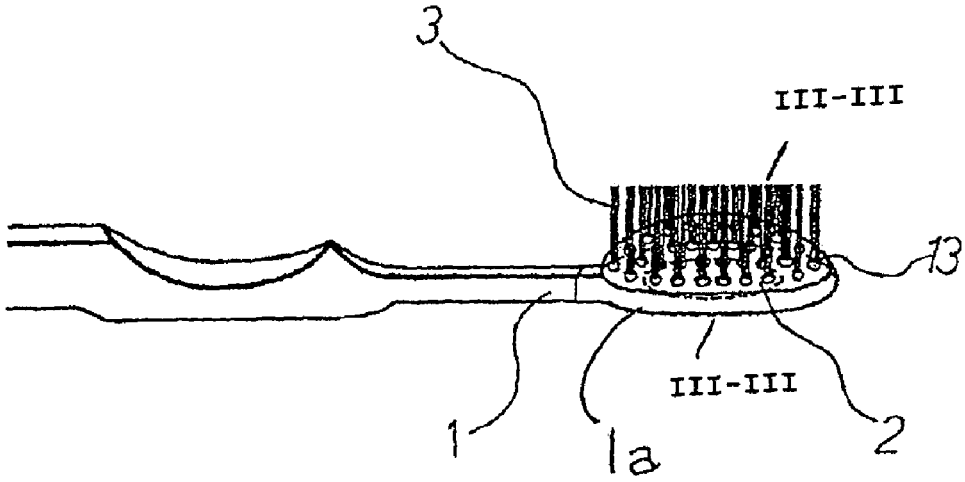
FIG. 1 is perspective view of the toothbrush according to an embodiment of the present invention.

FIG. 1 is a perspective view of a toothbrush according to an embodiment of the present invention, in which the toothbrush head 1*a* for constituting the inventive toothbrush is engaged with the brush base 2.

Figure 2:
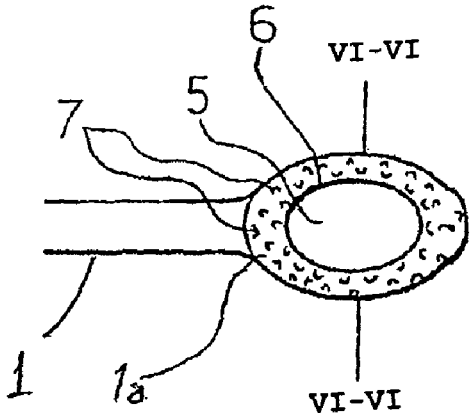
FIG. 2 is a perspective plan view of the stem of the toothbrush related to an embodiment of the present invention in which the brush base is removed from the toothbrush head, and illustrating the toothbrush head having an internal hole internally with a slit so as to enable the attachable and detachable brush base to be fixedly mounted therein.
Figure 21:
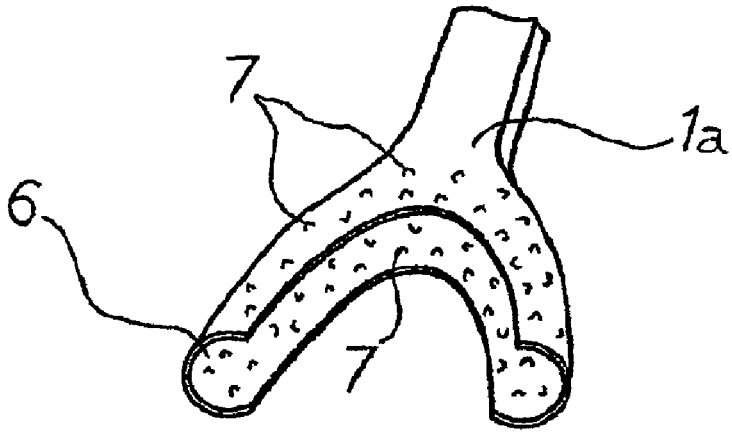
FIG. 21 is a cross-sectional perspective view of the stem of the toothbrush head sectioned across the line XXI-XXI shown to the left of FIG. 2, when the surfaces of the stem thereof and the slit is deformed into recessed and projected surfaces by forming a slit inside the hole shown in FIG. 2.

FIG. 2 is a perspective plan view of part of the stem 1 and the toothbrush head 1*a* disengaged from the brush base 2 consisting of a semispherical elastic member and bush bundles shown in FIG. 1. Hole 5 is formed through the toothbrush head 1*a*, where the through-holes are formed with recessed and projected surfaces 7. Anyone of thermoplastic resins may be used for composing the stem 1 and the toothbrush head. The stem 1 of the toothbrush according to the present invention is made from polypropylene. In addition, it is also allowable to use polyamide resin, polyethylene resin, cellulose propionate resin, polyester resin, and polymethylmethacryl resin, may also be used for example. Hole 5 formed through the toothbrush head 1*a* prevents the brush base 2 composed of an elastic member from excessively being deformed, and also enable air to be infused into and emitted from a hollow cavity 11 when a washing is performed and causing the back surface 11 of the brush base 2 composed of the elastic material to be deformed. To facilitate an attaching and detaching operation, a slit 6 is formed inside hole 5 formed through the toothbrush head 1*a* shown in FIG. 2. The slit 6 is internally formed with recessed and projected surfaces 7. FIG. 21 is a cross-sectional perspective view across the line VI-VI shown in FIG. 2 when the slit 6 is formed within the recessed and projected surfaces 7.

Figure 3:
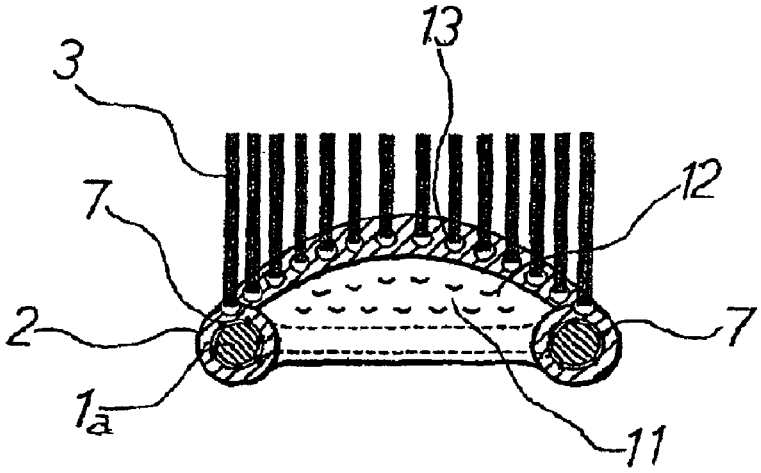
FIG. 3 is a cross-sectional view of the toothbrush across the line III-III shown in FIG. 1.

FIG. 3 is a cross-sectional view across the line shown in FIG. 1. The elastic material for composing part of the brush base 2 includes silicone rubber for example. However, any of conventional elastic materials being quite resistant to variable temperature, having lasting durability, and harmless to human health, may also be used without restriction. Since the hardness of the elastic material is not aimed at securing the recessed and projected amount of teeth, it is allowable to use a conventional elastic material having a slightly harder property than any of conventional counterparts. It is aimed that a substantial amount of the recesses and projections of teeth 4 be obtained via the recessed deformation of the elastic member. The elastic member is formed by covering the toothbrush head. Since FIG. 3 represents a cross-sectional view of the semi-spherical brush base 2 having a hollow cavity 11, when viewing the brush base 2 via the back surface of the elastic member, the brush-bundle source 13 is buried in the elastic member to enable the viewer to discern that the back surface 12 of the elastic member is slightly recessed and projected. Thickness of the elastic member viewed via the back surface 12 of the elastic member is not always identical to that is present in all portions. Individual brush bundles 3 used for embodying the present invention are made from conventional polyamide resin identified as nylon. However, the brush bundles 3 may also be made from polypropylene resin or polyester resin comprising polybutylene terephthalate for example. In order to prevent each component piece of individual brush bundles 3 from being disengaged, a method for welding the brush-bundle sources 13, a method for burying them upon hardening with synthetic resin or plastics, or a method for forming them in unity, can be executed without fear of degrading the retentive strength. In order that the brush bundles 3 can be flush with the toothbrush head 1*a* perpendicularly, the brush bundles 3 are secured to the semispherical brush base 2. Due to this arrangement, the brush bundles in the center portion and other brush bundles 3 in the peripheral portion are different in the length. Since the length of the brush bundles 3 are gradually contracted in the direction of the center of the brush base 2, when using the brush bundles 3 having identical material and an identical thickness, those brush bundles 3 in the center portion contains strong elasticity, and thus, they are hard, whereas those brush bundles 3 in the peripheral portion are softer than those which are disposed in the center portion. It is essential that the longest tip surfaces be flush with each other without necessarily arranging all the brush bundles 3 into an identical length. However, in this embodiment, upon consideration of the production cost, brush bundles 3 are totally arranged into an identical length. Note that the recessed and projected portions 7 are formed in the toothbrush head 1*a* to enable the elastic member to be fixed thereto securely. In order to engage the brush base 2 with the toothbrush head 1*a*, adhesive agent may be used. However, considering user's safety and the production cost on the part of producers, the embodiment of the present invention has formed the recessed and projected portions 7 in the stem 1 thereof in the unified practical formation of both components without resorting to adhesive agents at all.

Figure 4:
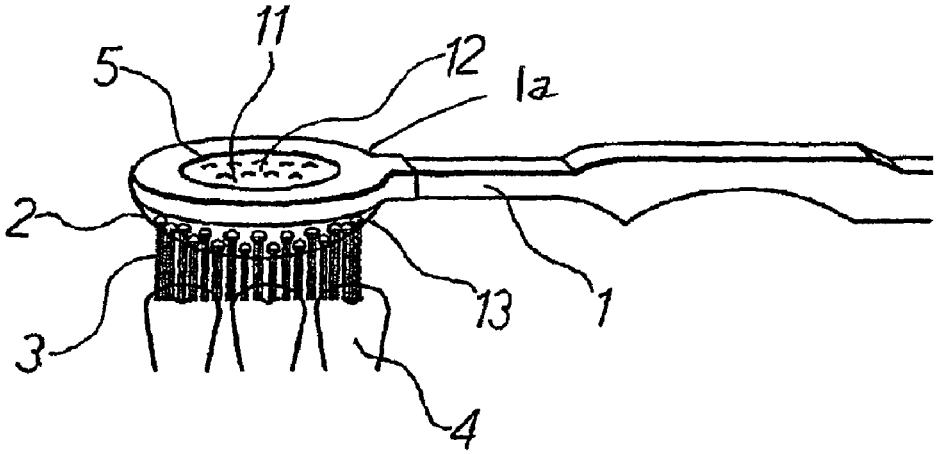
FIG. 4 is explanatory of the state in which the toothbrush according to the present invention is actually used via an ideal brushing method.

FIG. 4 is explanatory of the state in which the inventive toothbrush is actually used for brushing teeth with 200≈250 gram of pressure added to the brush bundles 3. The brushing base 2 consisting of the elastic member is not yet deformed, but individual brush bundles 3 are buried in the elastic member. FIG. 4 illustrates a state in which a teeth brushing process is practicable at a pressure absorptive rate within the least collapse before the elastic member starts own recessing deformation. In principle, it is desired that a teeth brushing process be continued while preserving the above condition.

Figure 5:
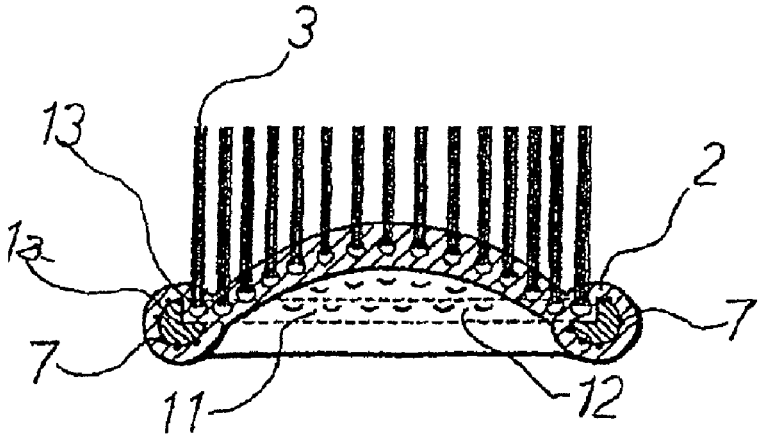
FIG. 5 is cross-sectional view of the toothbrush across the line III-III shown in FIG. 1 when the brush base related to the present invention is engaged with the toothbrush head la by way of covering the toothbrush head at a lower height.
Figure 6:
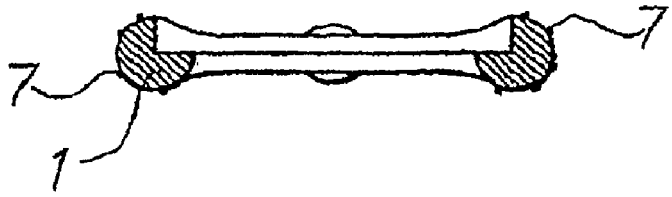
FIG. 6 is a cross-sectional view across the line VI-VI shown in FIG. 7.
Figure 7:
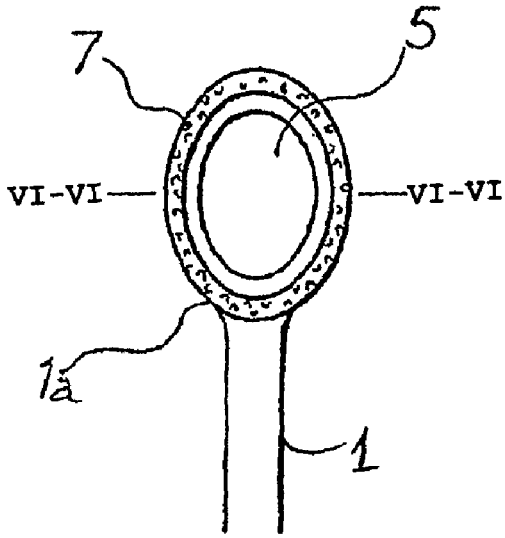
FIG. 7 is a perspective plan view of the stem of the toothbrush complete with a process that enables the bend of the elastic member to be suppressed inside the hole formed through the toothbrush head when pressure is added to the brush base engaged with the toothbrush head.

FIG. 5 is a cross-sectional view across the line which designates that the toothbrush head 1*a* is engaged with the brush base 2. When pressure is added to the toothbrush head 1*a* and the brush base 2 as the elastic member in the perpendicular direction, if a substantial pressure force added to the elastic member were dissipated externally, it will cause the elasticity generated by the collapse before the recessing deformation of the elastic member to be lowered. In order to reinforce the elasticity that incurred collapse of the elastic member comprising an elastic material having an identical thickness, the elastic member is disposed at a one-step lower position so as to be combined with the toothbrush head. This in turn enables the bend of the pressurized elastic member to be suppressed at the inner surface of hole 5 formed through the toothbrush head 1*a*. Hence, by referring to FIG. 3, it is possible to reinforce the elasticity up to the start of the recessing deformation of the elastic member without changing the material and thickness of elastic material. Accordingly, it is possible to vary the elasticity of the elastic member while preserving the elasticity constant at the portions where the brush bundles 3 are secured. Further, even when pressure is added to the elastic member from all directions, pressure can be suppressed within the inner surface of the toothbrush head 1*a* compatibly. FIG. 5 illustrates this condition that corresponds to the cross-sectional view across the line shown in FIG. 1. FIG. 7 is a perspective plan view designating a state in which the elastic brush base 2 covering the toothbrush head 1*a* shown in FIG. 5 is removed from the stem 1. FIG. 6 is a cross-sectional view across the line VI-VI of the elastic brush base 2.

Figure 8:
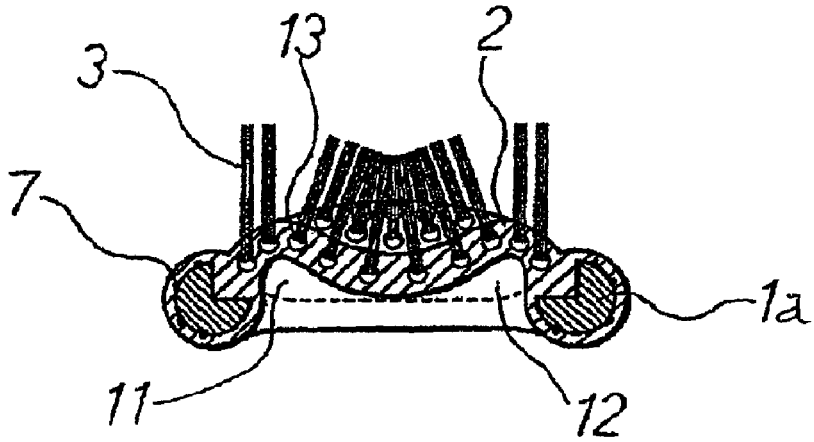
FIG. 8 is cross-sectional view across the line VIII-VIII shown in FIG. 11 that designates the state in which the toothbrush related to the present invention is actually used.
Figure 11:
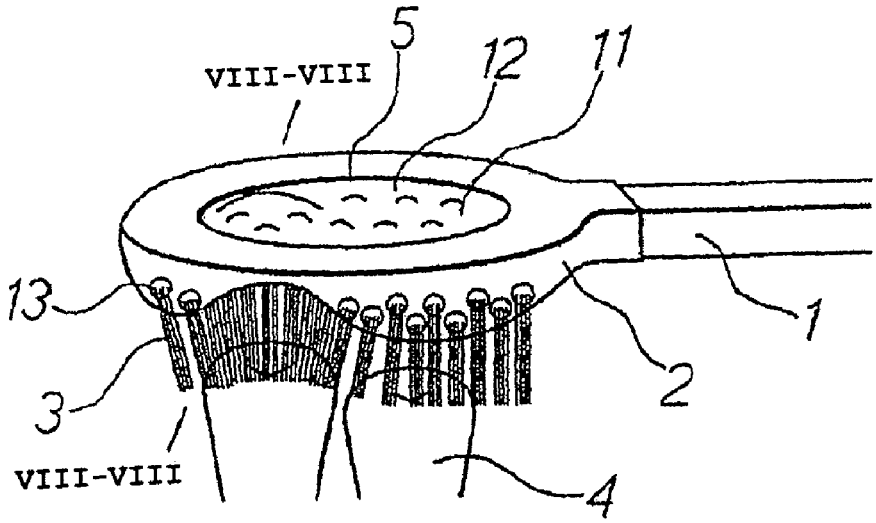
FIG. 11 is a perspective view for explanatory of the state in which intense pressure is initially added to part of the brush base.

FIG. 11 is a perspective view for explanatory of the actual condition of use, which designates an initial state of absorbing pressure after causing the elastic member to start own recessing deformation at a local portion where the brush bundles 3 incur substantial pressure. In this case, since substantial pressure is added to the brush bundles 3 on the front part via the center portion of the brush base 2, it is understood that the recessing deformation starts from the front portion of the brush base 2. FIG. 8 is a cross-sectional view across the line VIII-VIII shown in FIG. 11. It is understood that the brush bundles 3 oriented their direction towards the center of the recessed portion from the portion recessed via the deformation. By causing the brush bundles 3 to vary their orienting direction, the brush bundles 3 closely come into contact with teeth 4, and thus, while still absorbing pressure, teeth cleaning effect can hardly be lowered. Thence, depressurization enables the brush bundles 3 to quickly restore the original state. From the beginning of the recessing deformation up to the end thereof at the brush base 2, the portion at the fixed brush bundles 3 still retains the elasticity constant.

Figure 9:
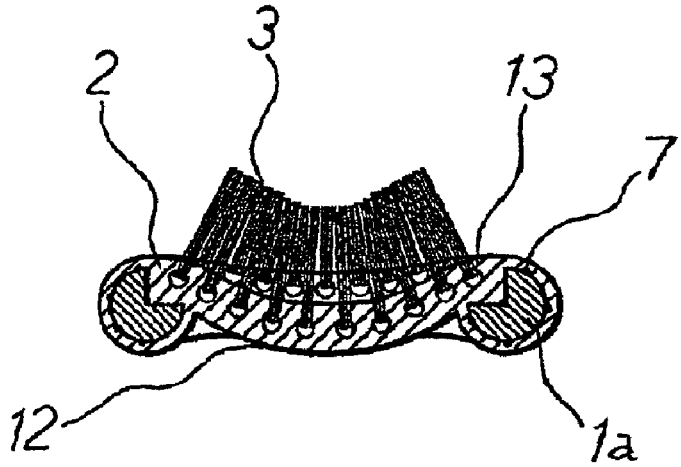
FIG. 9 is a cross-sectional view across the line IX-IX shown in FIG. 10 that designates the state in which the toothbrush related to the present is actually used.
Figure 10:
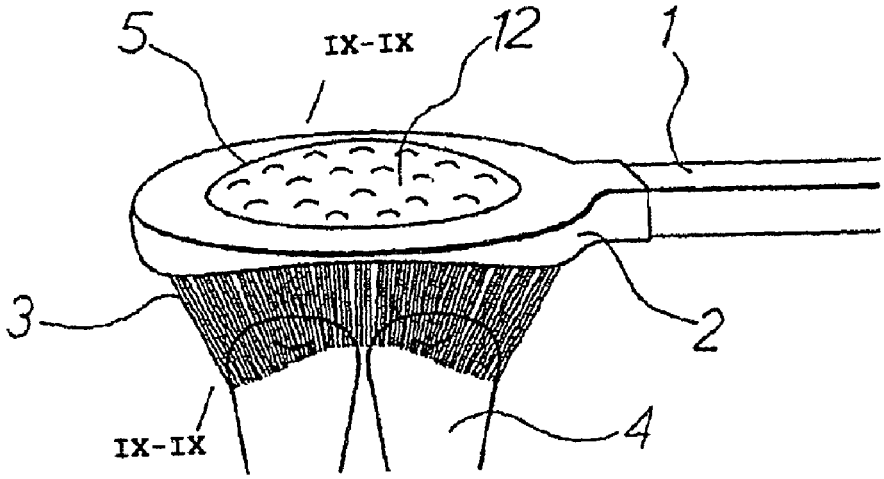
FIG. 10 is a perspective view for explanatory of the state in which intense pressure is added to the brush base.

FIG. 10 is a perspective view of the actual condition of use when excessive pressure is applied to the brush bundles 3. This condition approximates to the maximum deformable amount on the part of the inventive elastic brush base 2. However, even if this condition is present, teeth brushing effect can be retained. From the practical viewpoint, any further deformation is not anticipated. If further pressure is ever added to the brush bundles 3, the elastic member is conversely extended through hole 5 to become elastic, and thus, elastic effect can be retained. When the elasticity of the brush bundles 3 becomes lower than that of the elastic member, elastic deformation on the part of the elastic member is terminated to cause the deforming extent on the part of the brush bundles 3 to be expanded. Since the density of the brush bundles 3 is increased at the deformation ended position of the elastic member to which pressure from the brush bundles 3 is added to cause the elastic member to be recessed, those brush bundles 3 other than being present in the portion recessed via the deformation are oriented towards the center of the recessed portion. Hence, these brush bundles 3 are motivated to come into contact with teeth 4 as closely as possible. FIG. 9 is a cross-sectional view across the line IX-IX shown in FIG. 10.

Figure 14:
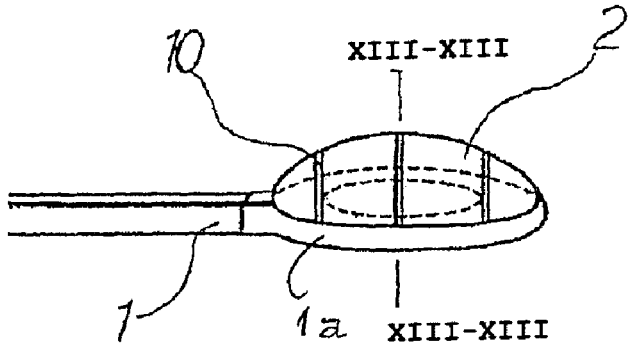
FIG. 14 is a perspective view of the brush base devoid of brush bundles, which is notched perpendicularly to the toothbrush head.
Figure 15:
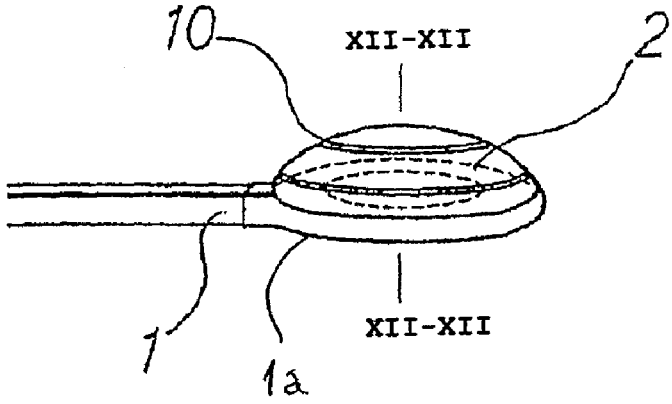
FIG. 15 is a perspective plan view of the spherically notched brush base devoid of brush bundles.

FIG. 14 and FIG. 15 are respectively a perspective view of the toothbrush head portion 1*a* or easier understanding thereof. The brush bundles 3 are not yet secured to the brush base 2. Each drawing illustrates the condition in which initial state of deformation caused by collapse of the brush base 2 at the initial stage is facilitated. FIG. 14 illustrates that notched portions 10 are formed on the brush base 2 in the direction orthogonal to the stem 1 of the toothbrush. FIG. 15 illustrates circular notches 10 formed on the brush base 2 via the plan view.

Figure 12:
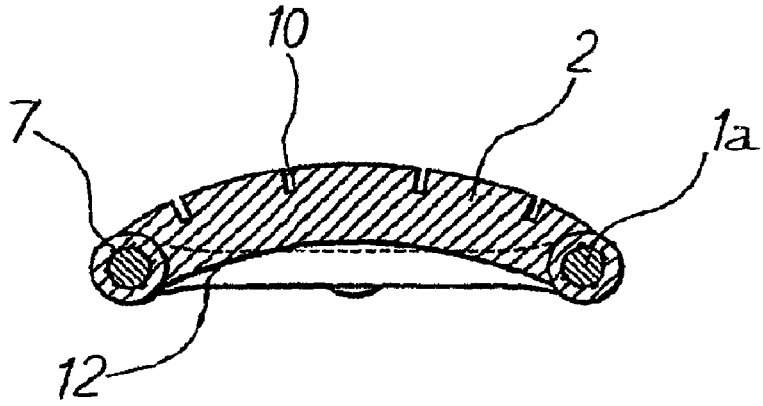
FIG. 12 is a cross-sectional view across the line XII-XII of the spherically notched brush base shown in FIG. 15 via a plan view.
Figure 13:
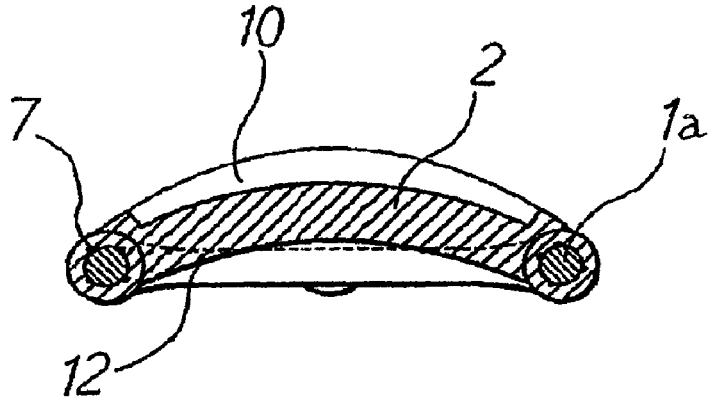
FIG. 13 is a cross-sectional view across the line XIII-XIII of the brush base shown in FIG. 14, which is notched perpendicularly to the stem of the toothbrush head.

Due to the above arrangement, an appropriate elasticity can be secured while performing a teeth brushing routine by applying approximately 200 grams of pressure. In the further steps, since no further space is available from the notched portions 10, elasticity is enhanced. FIG. 13 corresponds to the cross-sectional view across the line XIII-XIII shown in FIG. 14. FIG. 12 corresponds to the cross-sectional view across the line XII-XII shown in FIG. 15.

Figure 16:
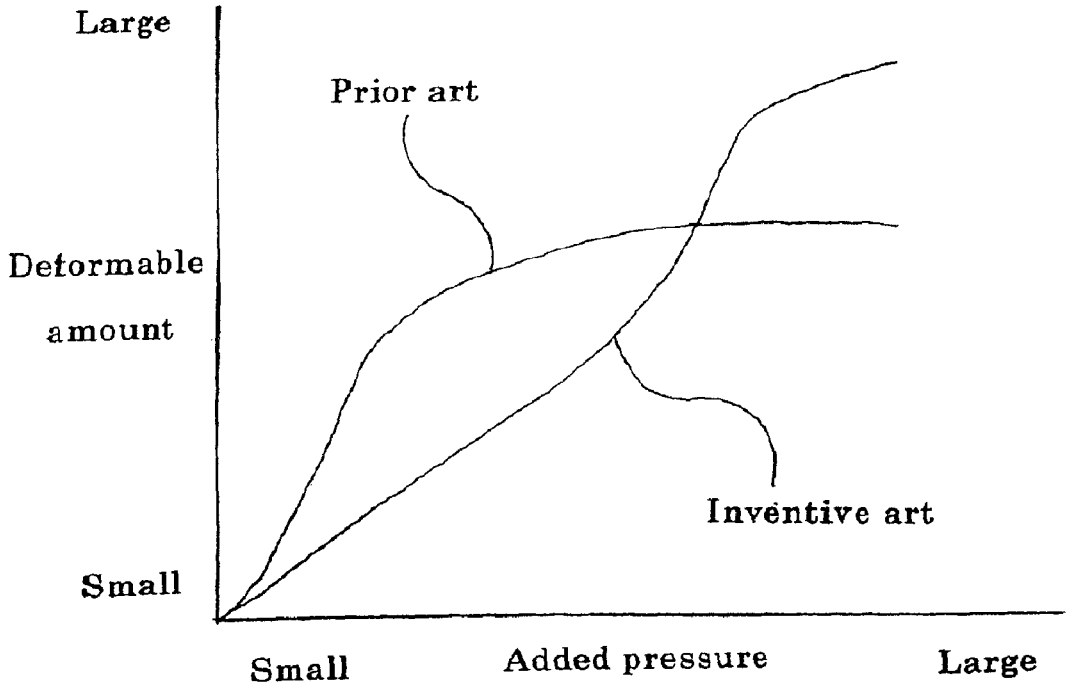
FIG. 16 is a graphic illustration for explanatory of the difference between a toothbrush using a conventional elastic member and the toothbrush according to the present invention as analyzed from the standpoint of pressure versus the deformed amount.

The graphic chart shown in FIG. 16 conditions a hypothesis that the length of brush bundles of any conventional toothbrush is assumed to be identical to that of the longest brush bundles secured to the elastic member related to the present invention while using those brush bundles composed of identical material and thickness, and further conditions that the total surface area of brush bundles via the plan view of the brush base is assumed to be equivalent to that of conventional brush bundles while the tip ends of both the inventive and conventional brush bundles are flush with each other. The graphic chart explains the difference of pressure and the deformable amount between the inventive toothbrush and any of the conventional toothbrushes that aims at absorbing the projections and recesses of teeth and excessively applied pressure via an elastic material or elastic member by applying the elastic material and elastic member to the brush-bundle fixing portion and the brush base. Pressure is gradually added to the stem of the toothbrush head before being added to the whole brush bundles perpendicularly. The difference of the way of causing the elastic material and elastic member of the conventional toothbrush to incur deformation and the inventive way of causing the elastic material and elastic member of the inventive toothbrush is explained below. In any of conventional toothbrushes, in response to the pressure initially added, the elastic material and elastic member respectively incur substantial deformation, and then the elastically deformed amount gradually decreases. Next, the inventive way of causing the brush bundles secured to the brush base 2 composed of an elastic member to incur the elastic deformation is explained below. The pressure added to the brush bundles 3 related to the present invention generates a collapse on the part of the semispherical elastic member as the brush base 2 before the elasticity of the elastic material disposed at the brush-bundle fixed portions and the elastic member itself are subject to the elastic deformation. As the added pressure rises, recessing deformation is initiated in the periphery of the center portion of the elastic member likely to easily generate the recessing deformation. This is because the pressure transmitted from the brush bundles is readily added to the surface of the elastic member perpendicularly. The other reason is explained below. Since the length of the brush bundles 3 is shorter than that of the external peripheral portion, and thus, the brush bundles 3 are harder than the external peripheral portion, thus generating substantial elasticity. Due to this reason, the brush bundles 3 can hardly absorb the added pressure to cause the elastic member to incur the added pressure directly. Simultaneously with the initiation of the elastic deformation on the part of the elastic member, as the recessing deformation goes on, the elastic deformation on the part of the elastic member corresponding to the brush-bundle 3 fixed portions that incurred the recessing deformation gradually ceases furtherance of the deformation in the outer direction from the center portion of the elastic member. This is because the brush bundles 3 secured to the brush base 2 perpendicularly to the toothbrush head 1*a* vary the oriented direction towards the center of the recessed portion of the elastic member. To achieve this, the pressure added to the elastic member secured to the brush-bundle fixed portion is varied. When the elastic member initiates own recessing deformation, the pressure added to the brush bundles 3 in the center portion shifts to the recessed portion of the elastic member from the elastic material itself, thereby preventing the elastic deformation of the elastic material secured to the brush-bundle fixed portion in the center portion from furtherance. After causing the recessing deformation to be ceased on the part of the elastic member, the elastic material extends itself to enhance own elasticity. After causing its elasticity to reach the critical limit, the brush bundles 3 deform themselves. Since the brush base 2 is configured into a semispherical elastic member, even when mean pressure is added to the toothbrush head 1*a* perpendicularly, in order to secure a deformed amount corresponding to that is obtainable from any conventional toothbrush, the elastic member according to the present invention requires a substantial pressure stronger than that is required for any conventional toothbrush. Hence, the elastically deformable amount at the beginning of the pressure adding process is less than that is obtainable from the conventional toothbrush. During a period ranging from the initiation of the elastic deformation on the part of the elastic member to the cease of the deformation, a substantial amount of the elastic deformation is generated on the part of the elastic member as the brush base 2 while retaining the elasticity of the elastic material disposed at the brush-bundle 3 fixed portion. After causing the elastic deformation to be ceased, the elastic material extends through hole 5 to enhance own elasticity to cause the elastic amount on the part of the elastic material to be decreased gradually. Hence, it is possible to secure a substantial deformable amount more than that is obtainable from any of conventional toothbrushes while preserving the elasticity at the brush-bundle fixed portion. FIG. 16 presents a graphic chart designating the relationship between the added pressure and the elastically deformed amount for easier explanation of the above description.

As described above, in the case of such a conventional toothbrush that provides an elastic member at the brush-bundle fixed portion, no pressure is required at the initial stage of elastic deformation. As the elastic deformation proceeds, unless substantial pressure is added relatively to the furtherance of the contraction and compression of the elastic material, the elastic deformation can hardly be expedited. In a practical use of the brush base 2 consisting of an elastic material according to the present invention, by way of observing the period ranging from the initial addition of pressure to the initiation of the recessing deformation on the part of the brush base 2 via a time axis, it is found that an insubstantial amount of elastic deformation is generated up to a period in which the brush base 2 begins with the recessing deformation. Assuming that there is a period that ranges from the initiation of the recessing deformation on the part of the brush base 2 up to the cease of the recessing deformation, the time required for securing a deformable amount is short without the needs for applying substantial pressure. Hence, when pressure is applied to the brush bundles 3 in the direction of the termination of eventual deformation, any of conventional toothbrushes fitted with conventional brush-bundle fixed portion and the brush base comprising an elastic material quickly arrives at the critical limit within a short period of time. On the other hand, when using the elastic member according to the present invention, elasticity of the elastic material disposed at the brush-bundle fixed portion does not vary noticeably, but the brush-bundle fixed portion generates a substantial amount of deformation of the elastic member while still preserving the elasticity. After terminating the elastic deformation, the elastic material conversely extends through hole 5 (refer to FIG. 10). Accordingly, even when being exposed to more than 500 grams of pressure, it is possible for the inventive toothbrush to minimize potential injury on the teeth 4, gum, and the brush bundles 3. Practical function of the inventive toothbrush on the way of performing a teeth brushing routine is briefly explained below. Any of conventional elastic members has an elasticity that exerts softness at the initial stage. After initiating the elastic deformation, hardness gradually increases. Initially, the brush base 2 comprising an elastic material related to the present invention is hard without requiring substantial pressure during a period ranging from the beginning of the recessing deformation on the part of the brush base 2 up to the cease of the recessing deformation. In this case, the brush bundles 3 are apt to gather themselves closely at the center portion. Further, there is a resistance on the part of the brush bundles 3 being in contact with the teeth 4 by attempting to deter the recessing deformation of the brush base 2. The elastic material facilitates the recessing deformation of the brush base 2. After ceasing the recessing deformation of the brush base 2, the elastic member is gradually hardened. A depressurizing process facilitates the brush base 2 so as to quickly restore its original state.

Figure 17:
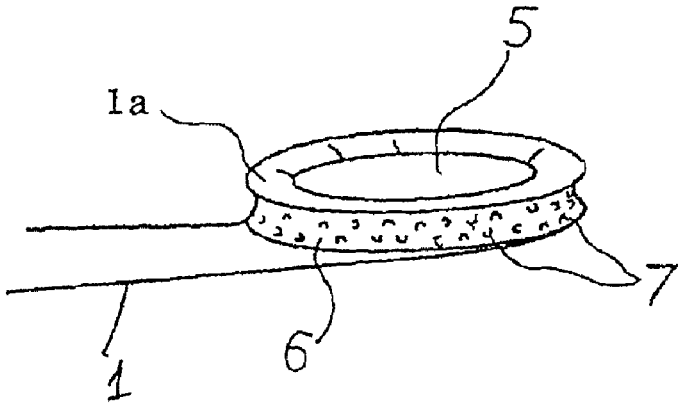
FIG. 17 is a perspective view of the toothbrush head, which is provided with a slit and recessed/projected portions in the external periphery of the hole formed through the toothbrush head for mounting the attachable and detachable brush base.
Figure 18:
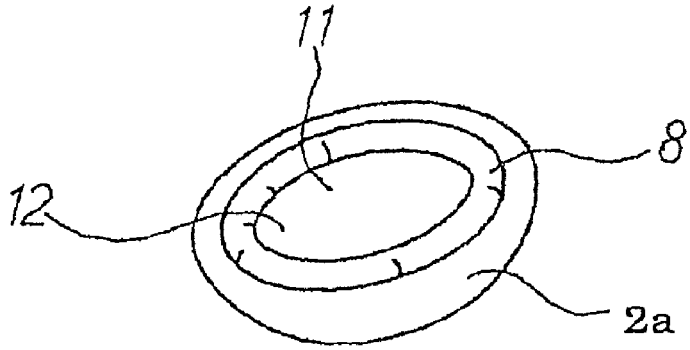
FIG. 18 is a perspective view of the attachable and detachable brush base devoid of brush bundles engaged with the annularly shaped elastic member.
Figure 19:
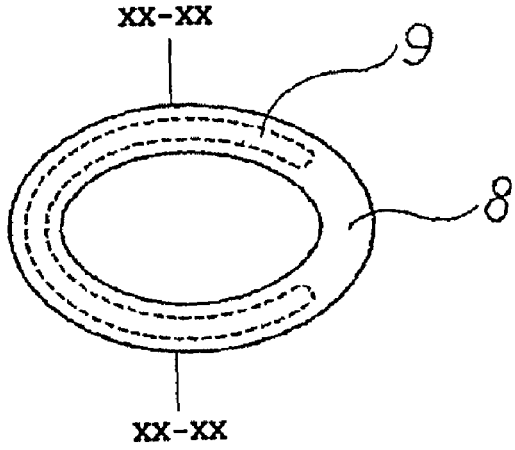
FIG. 19 is an enlarged view of the annularly shaped elastic member for explanatory of the state in which elastic synthetic resinous material is filled in the annularly shaped elastic member.
Figure 20:
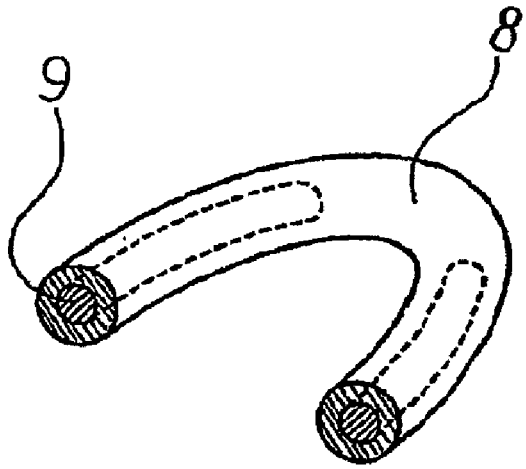
FIG. 20 is across-sectional perspective view shown to the right, which is sectioned across the line XX-XX shown in FIG. 19.

FIG. 18 is a perspective view of the brush base 2*a* via an upward observation, from which the brush bundles 3 are removed for easier understanding thereof. Consumable seat portion of the brush base 2 is attachable to and detachable from the toothbrush head 1*a* as the replaceable component. The brush base 2*a* shown here exerts own function identical to that is obtainable from the above-cited brush base 2 according to the present invention. The brush base 2*a* is engaged with an annularly formed elastic member 8 that is fixedly secured to the toothbrush head 1*a*. Availing of the elasticity and the expansibility and contractibility of the annularly formed elastic member 8, the annular elastic member 8 is secured to the toothbrush head 1*a*. Inventor has devised two methods for securing the annular elastic member 8 to the toothbrush head 1*a*. As discernible from a perspective view shown in FIG. 17, the first method secures the annular elastic member 8 to a slit 6 disposed outside hole 5 of the toothbrush head 1*a*. The other method secures the annular elastic member 8 to a slit 6 disposed inside the slit 6 of the toothbrush head 1*a* shown in FIG. 2. When securing the annular elastic member 8 to a slit 6 shown in FIG. 17 to implement the first method, the external diameter of the annular elastic member 8 is arranged to be smaller than the internal diameter of the slit 6 formed in the toothbrush head 1*a*. By causing the annular elastic member 8 to be engaged with part of the slit 6 of the toothbrush head 1*a*, the whole elastic member 8 is extended so as to be inserted into the slit 6 before being fixed therein. When implementing the other method, the annular elastic member 8 is secured to the slit 6 inside hole 5 of the toothbrush head 1*a*. In this case, the external diameter of the annular elastic member 8 is arranged to be identical to or slightly wider than the internal diameter of the slit 6. Further, in this case, as discernible from FIG. 19, a synthetic resinous substance 9 having elasticity is built in the annular elastic member 8. Material of this substance 9 is not solely limited to synthetic resin, but any kind of metal may also be used. However, in the present invention, considering the safety and the saving of resources, the above substance 9 is made from synthetic resin. By securely inserting the annular elastic member 8 incorporating the elastic substance 9 made from synthetic resin into the slit 6, the annular elastic member 8 restores the original form in the fixed condition. The elasticity proper to the synthetic resinous substance 9 can prevent the annular elastic member 8 from easily being freed from the slit 6. FIG. 20 is a perspective view across theline XX-XX shown in FIG. 19. Even when being secured to the toothbrush head 1*a*, the annular elastic member 8 incorporating the substance 9 made from synthetic resin effectively functions. In this case, as shown in FIG. 19, instead of inserting the annular elastic member 8 into the slit 6 via contraction, the annular elastic member is expanded and then inserted into part of the slit 6 before being restored into the original state. In this case, as shown in FIG. 19, local portion of the annular elastic member 8 devoid of the synthetic resinous substance 9 is extended so as to enable the whole elastic member 8 to be inserted into the slit 6, thereby easily being secured therein.

The toothbrush head 1*a* provided with the slit 6 shown in FIG. 2 and FIG. 17 constitutes the toothbrush head 1*a* fixedly loaded with the attachable and detachable brush base 2. The toothbrush head 1*a* is provided with the slit 6 that accommodates the annularly formed elastic member 8. In order to prevent the brush base 2 and the annular elastic member 8 from moving themselves via slipping, the inner surface of the slit 6 or the surface 7 of the toothbrush head 1*a* is recessed and projected. Due to the provision of the elasticity, the slit 6, and the recessed and projected surface 7, the annular elastic member 8 is stably secured. Accordingly, the brush base 2 can be prevented from being disengaged from the toothbrush head 1*a* via negligible force during a teeth bushing routine, and yet, the brush base 2 can also be prevented from being worn off otherwise caused by friction generated by the elastic member 8.

What is claimed is:

1. A toothbrush comprising:

a stem member;

a toothbrush head attached to one end of the stem member; and a toothbrush base provided with a plurality of brush bundles;

wherein said toothbrush base is made from an elastic material and formed into a semispherical configuration and is attachable to and detachable from the toothbrush head, and when the said toothbrush base is attached to the toothbrush head, top and bottom surfaces of the toothbrush base are exposed when viewing the toothbrush head from positions perpendicular to top and bottom sides of the toothbrush head, wherein the plurality of brush bundles is secured to the toothbrush base perpendicularly with respect to the toothbrush head, the toothbrush further comprising:

an annular member disposed in an concave-shaped annular slit of the toothbrush head, wherein the toothbrush base is attachable to the toothbrush head via the annular member, wherein the toothbrush head is formed with a hole penetrating from the top to the bottom of the toothbrush head, and wherein the concave-shaped annular slit is formed in an outside circular portion of the toothbrush head and an internal diameter of the bottom portion of the toothbrush base is slightly smaller than an external diameter of the slit, and the toothbrush base is engaged with the slit of the toothbrush head.

2. A toothbrush comprising:

a stem, a toothbrush head secured to the stem, the toothbrush head having an annular-shape, and a toothbrush base to which multiple brush bundles are secured, the toothbrush base being formed of an elastic material and formed into a semi-spherical configuration having an open bottom and a hollow cavity, the toothbrush base being secured to the annular-shaped toothbrush head by surrounding and covering a circumference of the toothbrush head, wherein each of the multiple brush bundles is secured to the toothbrush base so that brushes in each of the brush bundles have lengths which extend perpendicularly to a plane of the toothbrush head, and the lengths of the brushes in each of the brush bundles being shortest at a center of toothbrush base, the lengths gradually increasing in all directions toward peripheral portions of the toothbrush base so that tips ends of all of the brushes are all aligned in a plane parallel to the plane of the toothbrush head, wherein the toothbrush base is attachable to and detachable from the toothbrush head, and when the toothbrush base is attached to the toothbrush head, top and bottom surfaces of the toothbrush base are exposed when viewing the toothbrush head from a position perpendicular to top and bottom sides of the toothbrush head, wherein a concave slit is formed in an outside peripheral portion of the toothbrush head, and an internal diameter of the bottom of the toothbrush base is slightly smaller than the external diameter of the slit, and the toothbrush base is attachable to and detachable from the toothbrush head.

* * * * *